US007813513B2

(12) United States Patent
Hotho et al.

(10) Patent No.: US 7,813,513 B2
(45) Date of Patent: Oct. 12, 2010

(54) MULTI-CHANNEL ENCODER

(75) Inventors: Gerard H. Hotho, Eindhoven (NL); Dirk J. Breebaart, Eindhoven (NL); Evgeny A. Verbitskiy, Eindhoven (NL); Albertus C. Den Brinker, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 827 days.

(21) Appl. No.: 10/599,557

(22) PCT Filed: Mar. 25, 2005

(86) PCT No.: PCT/IB2005/051040

§ 371 (c)(1),
(2), (4) Date: Oct. 2, 2006

(87) PCT Pub. No.: WO2005/098824

PCT Pub. Date: Oct. 20, 2005

(65) Prior Publication Data

US 2007/0239442 A1 Oct. 11, 2007

(30) Foreign Application Priority Data

Apr. 5, 2004 (EP) ..... 04101405
Jun. 22, 2004 (EP) ..... 04102862

(51) Int. Cl.
*H04R 5/00* (2006.01)

(52) U.S. Cl. ..... 381/23; 704/200; 704/200.1; 381/22; 381/17; 381/18; 381/19; 381/1

(58) Field of Classification Search ..... 381/1, 381/17–19, 22–23; 704/200, 200.1
See application file for complete search history.

(56) References Cited

U.S. PATENT DOCUMENTS 7,193,538 B2 * 3/2007 Craven et al. ..... 341/50
7,447,317 B2 * 11/2008 Herre et al. ..... 381/23
2004/0049379 A1 * 3/2004 Thumpudi et al. ..... 704/205

FOREIGN PATENT DOCUMENTS

EP 1107232 A2 6/2001
WO WO2004008805 A1 1/2004

* cited by examiner

OTHER PUBLICATIONS

Chonavel et al: "Multi-Channel Linear Predictive Coding of Audio Signals"; 4th European Conference on Speech Communication and Technology, Eurospeech '95, Madrid, Spain, Sep. 18-21, 1995, vol. 1. Conf. 4, XP000854655.

*Primary Examiner*—Jakieda R Jackson

(57) ABSTRACT

There is described a method of encoding input signals (CHI to CH3; 400 to 450) in a multi-channel encoder (5; 15) to generate corresponding output data comprising down-mix output signals (610, 620) together with complementary parametric data (600). The method includes a first step of down-mixing input signals (CHI to CH3; 400 to 450) to generate the corresponding down-mix output signals (610, 620), and a second step of processing the input signals (CHI to CH3; 400 to 450) during down-mixing to generate said parametric data (600) complementary to the down-mix output signals (610, 620). Processing of the input signals (CHI to CH3; 400 to 450) involves including information in the down-mix signals (610, 620) which is useable during subsequent decoding of the down-mix output signals (610, 620) and the parametric data (600) to determine at least some parameter data and thereby enabling representations of the input signals (CHI to CH3; 400 to 450) to be subsequently regenerated. Coders for use in the encoder (5; 15) for performing essential signal processing operations therein are also elucidated.

13 Claims, 5 Drawing Sheets

MULTI-CHANNEL ENCODER

FIELD OF THE INVENTION

The present invention relates to multi-channel encoders, for example multi-channel audio encoders utilizing parametric descriptions of spatial audio. Moreover, the invention also relates to methods of processing signals, for example spatial audio, in such multi-channel encoders. Furthermore, the invention relates to decoders operable to decode signals generated by such multi-channel encoders.

BACKGROUND TO THE INVENTION

Audio recording and reproduction has in recent years progressed from monaural single-channel format to dual-channel stereo format and more recently to multi-channel format, for example five-channel audio format as often used in home movie systems. The introduction of super audio compact disks (SACD) and digital video disc (DVD) data carriers has resulted in such five-channel audio reproduction contemporarily gaining interest. Many users presently own equipment capable of providing five-channel audio playback in their homes; correspondingly, five-channel audio programme content on suitable data carriers is becoming increasingly available, for example the aforementioned SACD and DVD types of data carriers. On account of growing interest in multi-channel programme content, more efficient coding of multi-channel audio programme content is becoming an important issue, for example to provide one or more of enhanced quality, longer playing time and even more channels. Moreover, this growing interest has prompted standardization bodies such as MPEG to appreciate that design of multi-channel encoders is a relevant topic.

Encoders capable of representing spatial audio information such as audio programme content by way of parametric descriptors are known. For example, in a published international PCT patent application no. PCT/IB2003/002858 (WO 2004/008805), encoding of a multi-channel audio signal including at least a first signal component (LF), a second signal component (LR) and a third signal component (RF) is described. This encoding utilizes a method comprising steps of:

(a) encoding the first and second signal components by using a first parametric encoder for generating a first encoded signal (L) and a first set of encoding parameters (P2);

(b) encoding the first encoded signal (L) and a further signal (R) by using a second parametric encoder for generating a second encoded signal (T) and a second set of encoding parameters (P1) wherein the further signal (R) is derived from at least the third signal component (RF); and (c) representing the multi-channel audio signal at least by a resulting encoded signal (T) derived from at least the second encoded signal (T), the first set of encoding parameters (P2) and the second set of encoding parameters (P1).

Parametric descriptions of audio signals have gained interest in recent years because it has been shown that transmitting quantized parameters describing audio signals requires relative little transmission capacity. These quantized parameters are capable of being received and processed in decoders to regenerate audio signals perceptually not significantly differing from their corresponding original audio signals.

A problem of significant inter-channel interference arises when output from contemporary multi-channel encoders is subsequently decoded. Such interference is especially noticeable in multi-channel encoders arranged to yield a good stereo image in association with two-channel down-mix. The present invention is arranged to at least partially address this problem, thereby enhancing the quality of corresponding decoded multi-channel audio.

SUMMARY OF THE INVENTION

An object of the present invention is to provide an alternative multi-channel encoder or block that can be used within a multi-channel encoder which is susceptible to generating encoded output data which is subsequently capable of being decoded with reduced inter-channel interference.

According to a first aspect of the present invention, there is provided a multi-channel encoder operable to process input signals conveyed in a plurality of input channels to generate corresponding output data comprising down-mix output signals together with complementary parametric data, the encoder including:

(a) a down-mixer for down-mixing the input signals to generate the corresponding down-mix output signals; and (b) an analyzer for processing the input signals, said analyzer being operable to generate said parametric data complementary to the down-mix output signals, said encoder being operable when generating the down-mix output signals to allow for subsequent decoding of the down-mix output signals for predicting signals of channels processed and then discarded within the encoder.

The invention is of advantage in that the output data from the encoder is susceptible to being decoded with reduced inter-channel interference, namely enabling enhanced subsequent regeneration of the input signals.

Moreover, the amount of data output from the multi-channel encoder required to represent the input signals is also potentially reduced.

Preferably, the encoder is operable to process the input signals on the basis of time/frequency tiles. More preferably, these tiles are defined either before or in the encoder during processing of the input signals.

Preferably, in the encoder, the analyzer is operable to generate at least part of the parametric data ($C_{1,i}$;$C_{2,i}$) by applying an optimization of at least one signal derived from a difference between one or more input signals and an estimation of said one or more input signals which can be generated from output data from the multi-channel encoder. More preferably, the optimization involves minimizing an Euclidean norm.

Preferably, in the encoder, there are N input channels which the analyzer is operable to process corresponding original input signals of the N input channels to generate for each time/frequency tile the parametric data, the analyzer being operable to output M(N−M) parameters together with M down-mix output signals for representing the input signals in the output data, M and N being integers and M<N. More preferably, in a case of the integer M being equal to two in the encoder, the down-mixer is operable to generate two down-mix output signals which are susceptible to being replayed in two-channel stereophonic apparatus and being coded by a standard stereo coder. Such a characteristic is capable of rendering the encoder and its associated output data backwardly compatible with earlier replay systems, for example stereophonic two-channel replay systems.

According to a second aspect of the invention, there is provided a signal processor for inclusion in a multi-channel encoder according to the first aspect of the invention, the processor being operable to process data in the multi-channel encoder for generating its down-mix output signals and parametric data.

According to a third aspect of the invention, there is provided a method of encoding input signals in a multi-channel encoder to generate corresponding output data comprising down-mix output signals together with complementary parametric data, the method including steps of:

(a) providing the input signals to the multi-channel encoder via a plurality (N) of input channels;

(b) down-mixing the input signals to generate the corresponding (M) down-mix output signals; and (c) processing the input signals to generate said parametric data complementary to the down-mix output signals, wherein processing of the input signals in the multi-channel encoder involves determining the parameter data for enabling representations of the input signals to be subsequently regenerated, said down-mix signals allowing for decoding thereof for predicting content of signals of channels processed in the encoder and then discarded therein.

According to a fourth aspect of the invention, there is provided encoded output data generated according to the method of the third aspect of the invention, said output data being stored on a data carrier.

According to a fifth aspect of the invention, there is provided a decoder for decoding output data generated by an encoder according to the first aspect of the invention, the decoder comprising:

(a) processing means for receiving down-mix output signals together with parametric data from the encoder, the processing means being operable to process the parametric data to determine one or more coefficients or parameters; and (b) computing means for calculating an approximate representation of each input signal encoded into the output data using the parameter data and also the one or more coefficients determined in step (a) for further processing to substantially regenerate representations of input signals giving rise to the output data generated by the encoder.

According to a sixth aspect of the invention, there is provided a signal processor for inclusion in a multi-channel decoder according to the fifth aspect of the invention, the signal processor being operable to assist in processing data in association with regenerating representations of input signals.

According to a seventh aspect of the invention, there is provided a method of decoding encoded data in a multi-channel decoder, said data being of a form as generated by a multi-channel encoder according to the first aspect of the invention, the method including steps of:

(a) processing down-mix output signals together with parametric data present in the encoded data, said processing utilizing the parametric data to determine one or more coefficients or parameters; and (b) calculating an approximate representation of each input signal encoded into the encoded data using the parameter data and also the one or more coefficients determined in step (a) for further processing to substantially regenerate representations of input signals giving rise to the encoded data generated by the encoder.

It will be appreciated that features of the invention are susceptible to being combined in any combination without departing from the scope of the invention.

DESCRIPTION OF THE DIAGRAMS

Embodiments of the invention will now be described, by way of example only, with reference to the following diagrams wherein.

DESCRIPTION OF EMBODIMENTS OF THE INVENTION

The present invention will be described in first and second contexts. In the first context, the invention is concerned with an encoder which is operable to process original input signals to generate corresponding encoded output data capable on being subsequently decoded in a decoder to regenerate perceptually more precise representations of the original input signals than hitherto possible. In the second context, the invention is concerned with specific example embodiments of the invention.

Figure 1:
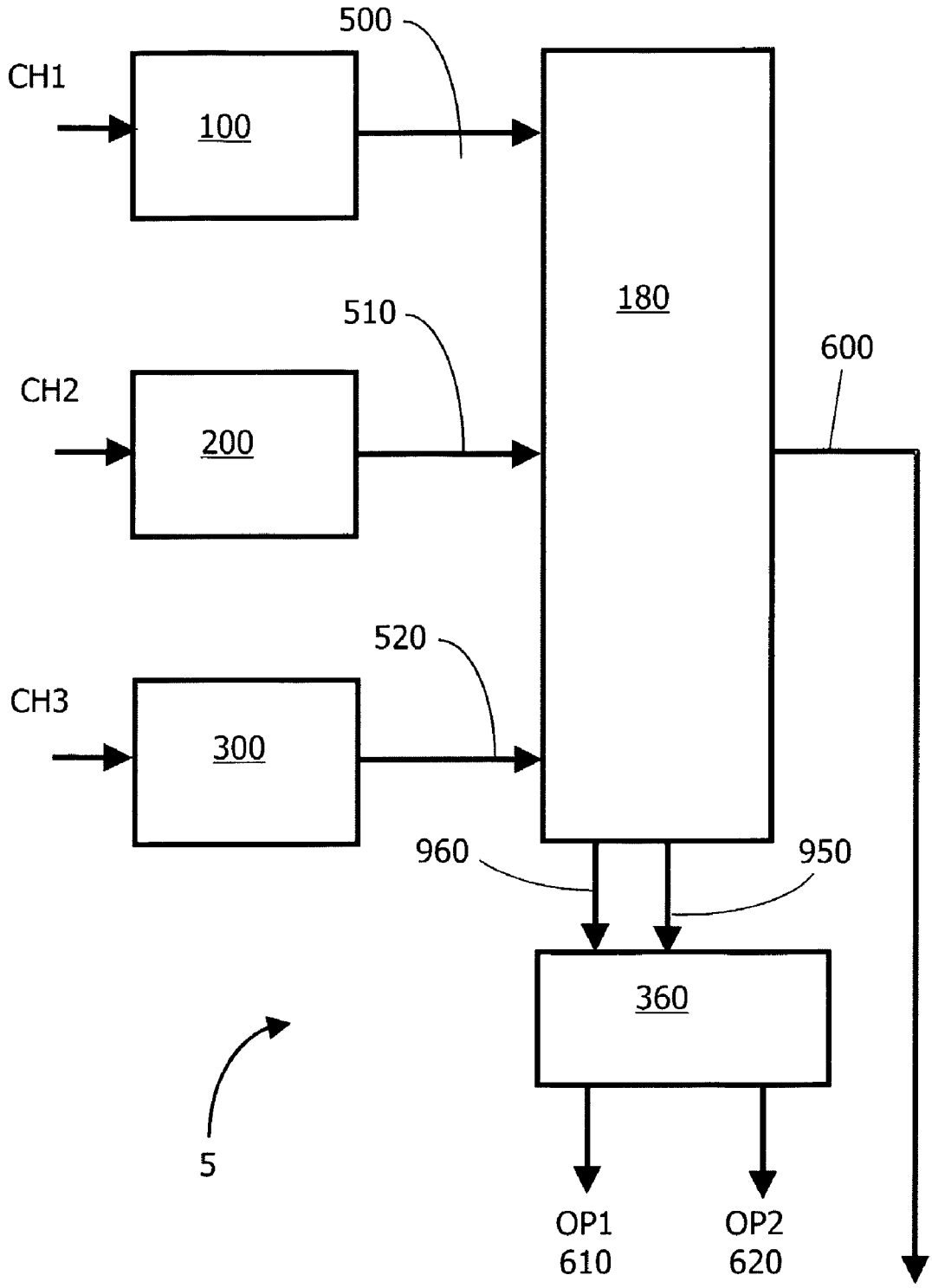
FIG. 1 is a schematic block diagram of an embodiment of a multi-channel encoder including therein a coder according to the invention in relation to a first context of the invention.
Figure 2:
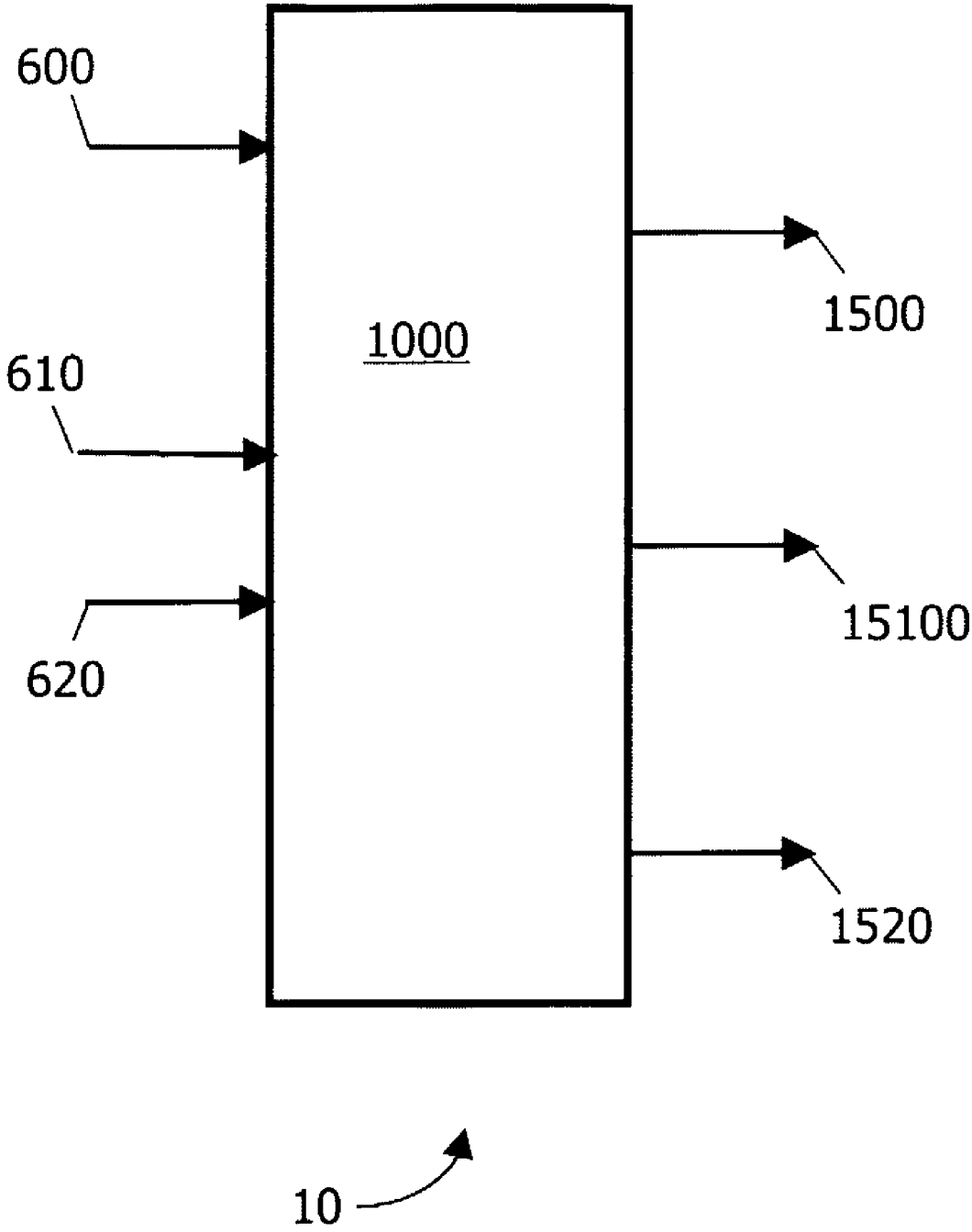
FIG. 2 is a schematic block diagram of an embodiment of a decoder according to the invention compatible with the encoder of FIG. 1 in relation to the first context of the invention.

The first context will now be considered with regard to FIGS. 1 and 2. In overview, the present invention is concerned with an encoder indicated generally by 5 in FIG. 1. The encoder 5 includes N input channels for receiving corresponding original input signals; for example, the encoder includes three input channels CH1, CH2, CH3 when N=3. The encoder 5 is operable to process the original input signals of the N channels to generate:

(a) corresponding encoded output signals at M down-mix channel outputs where M<N, for example two channel outputs OP1 and OP2 denoted by 610, 620 respectively when M=2; and (b) one or more parametric signal outputs, for example a parametric output denoted by 600.

In order subsequently to most optimally decode in a decoder output signals generated by the encoder 5, namely with regard to least-squares-errors, it is contemporarily beneficial that Principal Component Analysis (PCA) be employed in the encoder 5 when generating its encoded output signals 600, 610, 620. Processing of these output signals 600, 610, 620 for best possible regeneration of signals at a decoder indicated by 10 in FIG. 2 corresponding to the N input signals presented to the encoder 5 is potentially possible if parameters generated by PCA of the encoder 5 are taken into account. Values for PCA parameters in the signals 600, 610, 620 are induced by the original input signals themselves and therefore allow no control over down-mixing occurring in the encoder 5. Such lack of control renders it contemporarily substantially impossible to obtain a satisfactory stereo image quality when PCA is employed in the encoder 5 and its corresponding decoder 10.

The inventors have appreciated for the present invention that, when a fixed down-mix is employed in conjunction with the aforementioned M down-mix channels in the encoder 5, a substantially perfect regeneration of the original input signals at the complementary decoder 10 is potentially possible when these M down-mix channels are extended by way of an additional appropriate set of N−M channels conveying complementary information. Thus, output signals of M down-mix channels generated by a fixed down-mix cannot be used to regenerate substantially perfect representations of original input signals of N channels when information relating to such N−M channels has been at least partially discarded during encoding. However, the inventors have appreciated that these N−M channels can at least partially be predicted when suitable processing is applied to the M down-mix channels, for example to the outputs 610, 620.

Thus, an encoder 5 configured according to the invention predicts from the M down-mix channels at least some information corresponding to the N−M channels at a decoder, while at the same time avoiding a need to send certain parameters from the encoder 5 to the decoder 10. Such prediction makes use of signal redundancy occurring between signals of the N channels as will be described in more detail later. Moreover, the correspondingly compatible decoder 10 reinstates the redundancy when decoding encoded data provided from the encoder 5.

In order to further elucidate the present invention, an example embodiment of the encoder 5 illustrated in FIG. 1 will be described and then a method of signal processing employed therein will be presented with reference to its mathematical basis.

The example embodiment of the invention pursuant to the aforementioned second context will now be described with reference to FIGS. 3 and 4.

Figure 3:
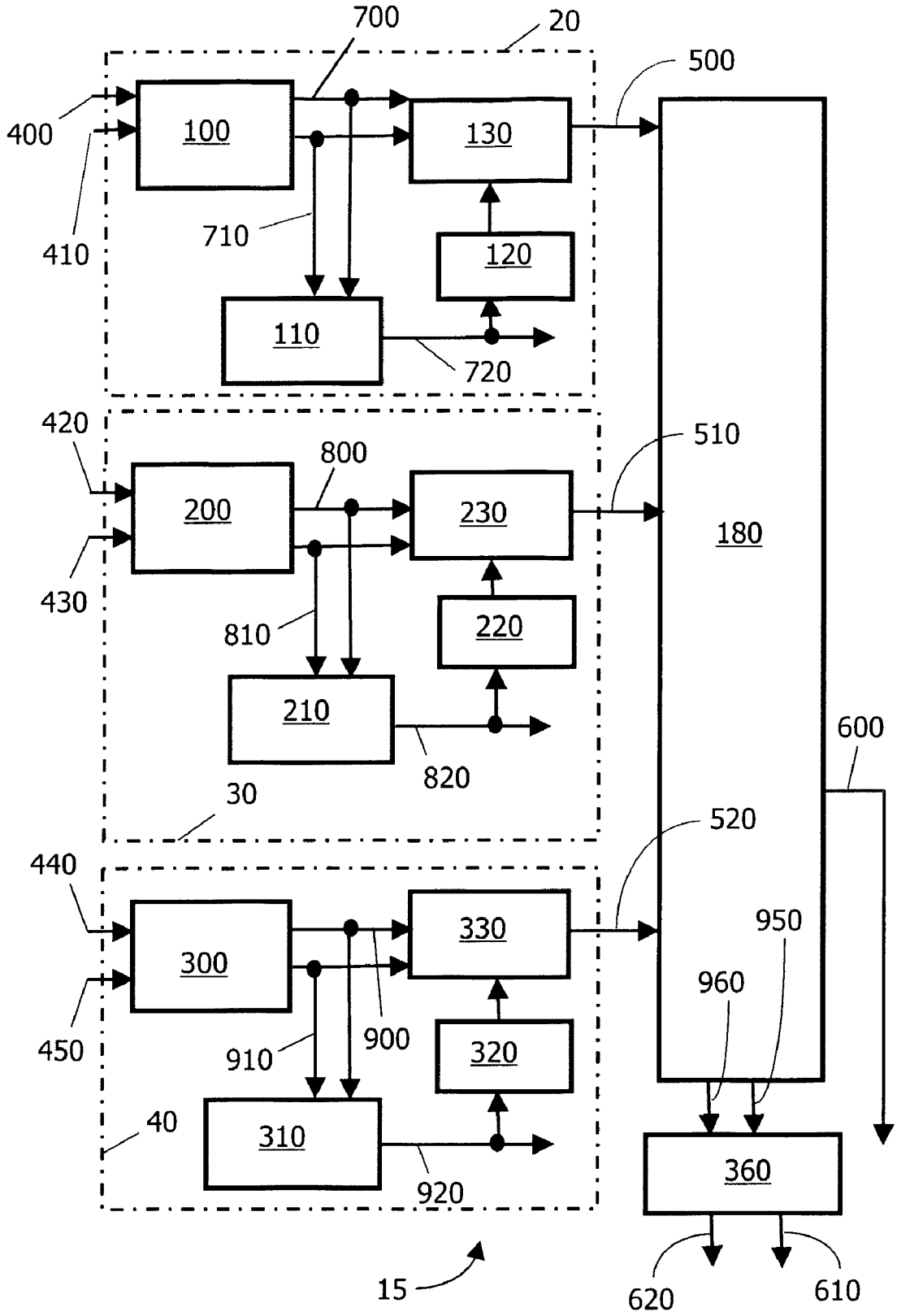
FIG. 3 is a preferred embodiment of the invention wherein the coder is employed within a multi-channel encoder according to the invention in relation to a second context of the invention.
Figure 4:
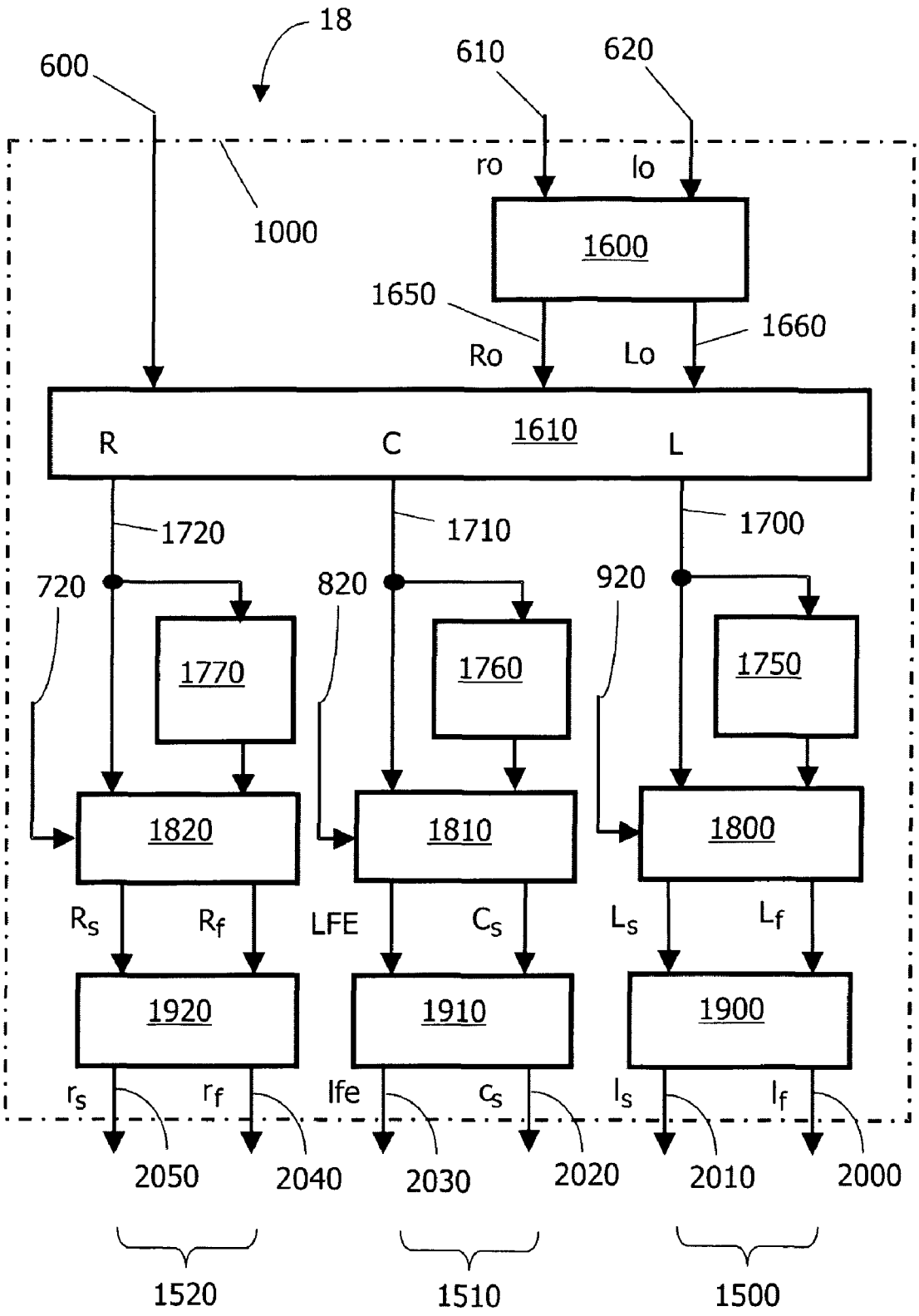
FIG. 4 is an embodiment of a decoder, using the coder of the invention, compatible with the encoder of FIG. 3 in relation to the second context of the invention.

In FIG. 3, there is shown a multi-channel encoder indicated generally by 15. The encoder 15 includes three processing units 20, 30, 40 for receiving six input signals denoted by 400 to 450; the nature of these six input signals will be elucidated later. The three processing units 20, 30, 40 are operable to generate the aforementioned N channels 500 to 520 described with reference to the encoder 5. The encoder 15 also comprises a mixing and parameter extraction unit 180 for receiving processed outputs 500, 510, 520 of the processing units 20, 30, 40 respectively. Outputs from the extraction unit 180 comprise the aforementioned third parameter set output 600, and left and right intermediate signals 950, 960 respectively connected via an inverse transform and OLA unit 360 to generate the aforesaid down-mix outputs 610, 620 for left and right channels respectively. Parameter output sets 720, 820, 920, 600 and the down-mix outputs 610, 620 correspond to encoded output data from the encoder 15 suitable for being subsequently communicated to a corresponding compatible decoder whereat the output data is decoded to regenerate representations of one or more of the six input signals 400 to 450. Alternatively, the down-mix outputs 610 and 620 can be supplied to a standard stereo coder.

The six original input signals denoted by 400 to 450 comprise: a left front audio signal 400, a left rear audio signal 410, an effects audio signal 420, a center audio signal 430, a right front audio signal 440 and a right rear audio signal 450. The effects signal 420 preferably has a bandwidth of substantially 120 Hz for use in simulating rumble, explosion and thunder effects for example. Moreover, the input signals 400, 410, 430, 440, 450 preferably correspond to 5-channel home movie sound channels.

The processing units 20, 30, 40 are preferably implemented in a manner elucidated in published European patent application no. EP 1, 107, 232 which is hereby incorporated by reference with regard to these units 20, 30, 40.

The processing unit 20 comprises a segment and transform unit 100, a parameter analysis unit 110, a parameter to PCA angle unit 120 and a PCA rotation unit 130. The transform unit 100 includes transformed left-front and left-rear outputs 700, 710 respectively coupled to the PCA rotation unit 130 and the parameter analysis unit 110. A first parameter set output 720 is coupled via the PCA angle unit 120 to the PCA rotation unit 130. The rotation unit 130 is operable to process the outputs 700, 710 and the first parameter set output to generate the processed output 500. Processing within the unit 20 is performed on the basis of time/frequency tiles.

Similarly, the processing unit 30 comprises a segment and transform unit 200, a parameter analysis unit 210, a parameter to PCA angle unit 220 and a PCA rotation unit 230. The transform unit 200 includes transformed effects audio and centre audio outputs 800, 810 respectively coupled to the PCA rotation unit 230 and the parameter analysis unit 210. A fourth parameter set output 820 is coupled via the PCA angle unit 220 to the PCA rotation unit 220. The rotation unit 220 is operable to process the outputs 800, 810 and the fourth parameter set output to generate the processed output 510. Processing within the unit 30 is also performed on the basis of time/frequency tiles.

Similarly, the processing unit 40 comprises a segment and transform unit 300, a parameter analysis unit 310, a parameter to PCA angle unit 320 and a PCA rotation unit 330. The transform unit 300 includes transformed right-front and right-rear outputs 900, 910 respectively coupled to the PCA rotation unit 330 and the parameter analysis unit 310. A second parameter set output 920 is coupled via the PCA angle unit 320 to the PCA rotation unit 330. The rotation unit 330 is operable to process the outputs 900, 910 and the second parameter set output to generate the processed output 520. Processing within the unit 40 is performed on the basis of time/frequency tiles.

The processed outputs 500, 510, 520 correspond to left, center and right processed signals respectively. Moreover, the down-mix outputs 610, 620 are susceptible to being replayed via contemporary two-channel stereo playback apparatus thereby maintaining backward compatibility with earlier stereo sound systems. The third parameter set output 600 includes additional parameter data which can be processed at a decoder, for example the decoder 10 illustrated in FIG. 2, together with the output parameter sets 720, 820, 920 and the down-mix outputs 610, 620 to regenerate representations of the six input signals 400 to 450. A manner in which this down-mix occurs to produce the down-mix outputs 610, 620 and the parameter data at the third parameter set output 600 will next be described.

Referring again to the first context of the invention with regard to FIGS. 1 and 2, the original input signals of N channels CH1 to CH3, namely $z_1[n]$, $z_2[n]$, . . . , $z_N[n]$, describe discrete time-domain waveforms of the N channels. These signals $z_1[n]$ to $z_N[n]$ are segmented in the three processing units 20, 30, 40, such segmentation using a mutual common segregation, preferably employing temporally overlapping analysis windows. Subsequently, each segment is converted from being in a temporal format to being in a frequency format, namely from the time domain to the frequency domain, by way of applying a suitable transform, for example a Fast Fourier Transform (FFT) or similar equivalent type of transformation. Such format conversion is preferably implemented in computing hardware executing suitable software. Alternatively, the conversion can be implemented using filter-bank structures to obtain time/frequency tiles. Moreover, the conversion results in segmented sub-band representations of the input signals for the channels CH1 to CH3. For convenience, these segmented sub-band representations of the input signals $z_1[n]$ to $z_N[n]$ are denoted by $Z_1[k]$ to $Z_N[k]$ respectively wherein k is a frequency index.

For convenience, we consider two down-mix channels as illustrated for the encoder 15, although extension to other numbers of down-mix channels is possible. From the original input signals conveyed in N channels CH1 to CH3, the encoder 5 processes the aforesaid sub-band representations $Z_1[k]$ to $Z_N[k]$ to generate two down-mix channels $L_0[k]$ and $R_0[k]$ as provided in Equations 1 and 2 (Eq. 1 and 2):

$$L_0[k] = \sum_{i=1}^{N} \alpha_i Z_i[k] \quad \text{Eq. 1}$$

$$R_0[k] = \sum_{i=1}^{N} \beta_i Z_i[k] \quad \text{Eq. 2}$$

wherein parameters $\alpha_i$ and $\beta_i$ are preferably set as required for good stereo image in the two down-mix channels $L_0[k]$ and $R_0[k]$. As elucidated in the foregoing, a subsequent decoder, for example the decoder 10 regenerating representations of the original input signals for CH1 to CH3 is only capable of generating substantially perfect representations when the two down-mix channels $L_0[k]$ and $R_0[k]$ are supplemented with an appropriate set of parameters to substantially regenerate the N−2 missing channels. When fixed down-mixing is employed, to some extent, information of the N−2 discarded channels can be predicted from the two down-mix channels $L_0[k]$ and $R_0[k]$, thereby providing a way of enhancing accuracy of regeneration of the aforesaid representation of the original input signals of channels CH1 to CH3 at a corresponding decoder, for example the decoder 10.

In a situation where information relating to certain of the N channels is discarded in generating the output signals 600, 610, 620, namely the discarded channels are denoted by $C_{0,i}[k]$, these discarded channels can be predicted from the down-mix channels $L_0[k]$ and $R_0[k]$ by applying Equation 3 (Eq. 3):

$$\hat{C}_{0,i}[k] = \tilde{C}_{1,i} L_0[k] + \tilde{C}_{2,i} R_0[k] \quad \text{Eq. 3}$$

wherein parameters $\tilde{C}_{1,i}$ and $\tilde{C}_{2,i}$ are selected according to one or more optimization criteria. Preferably, an optimization criterion employed in the encoder 5 is a minimum Euclidean norm of the signal $C_{0,i}[k]$ and its estimation $\hat{C}_{0,i}[k]$. In order to allow for processing according to Equation 3 to be employed in a decoder complementary to the encoder 5, the parameters $\tilde{C}_{1,i}$ and $\tilde{C}_{2,i}$ are preferably included in the third parameter set 600 output from the encoder 5.

The inventors have appreciated that the parameters $\tilde{C}_{1,i}$ and $\tilde{C}_{2,i}$ in Equation 3 are related to parameters that are generated in the encoder 5 when minimizing the Euclidean norm of the difference of the signal $Z_i[k]$ and an estimation $\hat{Z}_i[k]$ thereof generated at the decoder 10. The encoder 5 preferably is configured to employ these latter parameters $Z_i[k]$, $\hat{Z}_i[k]$. A square of the Euclidean norm of the difference of the original input signal $Z_i[k]$ is then calculable in the encoder 5 by applying Equation 4 (Eq. 4):

$$\sum_k \left| Z_i[k] - \hat{Z}_i[k] \right|^2 \quad \text{Eq. 4}$$

$$\text{wherein } \hat{Z}_i[k] = C_{1,Z_i} L_0[k] + C_{2,Z_i} R_0[k] \quad \text{Eq. 5}$$

Minimization of Equation 4 is preferably achieved by applying Equations 6 and 7 (Eq. 6 and 7):

$$C_{1,Z_i} = \frac{\langle L_0[k], Z_i[k]\rangle^* \|R_0[k]\|^2 - \langle R_0[k], Z_i[k]\rangle^* \langle L_0[k], R_0[k]\rangle^*}{\|L_0[k]\|^2 \|R_0[k]\|^2 - |\langle L_0[k], R_0[k]\rangle|^2} \quad \text{Eq. 6}$$

$$C_{2,Z_i} = \frac{\langle R_0[k], Z_i[k]\rangle^* \|L_0[k]\| - \langle L_0[k], Z_i[k]\rangle^* \langle L_0[k], R_0[k]\rangle}{\|L_0[k]\|^2 \|R_0[k]\|^2 - |\langle L_0[k], R_0[k]\rangle|^2} \quad \text{Eq. 7}$$

wherein $$\|A[k]\|^2 = \sum_k |A[k]|^2 \quad \text{Eq. 8}$$

$$\langle A[k], B[k]\rangle = \sum_k A[k] B^*[k] \quad \text{Eq. 9}$$

Thus, for the parameters $C_{1,Z_i}$ and $C_{2,Z_i}$ as calculable from Equations 6 and 7, the following relationships are derivable from Equations 10 to 13 (Eq. 10 to 13) with regard to coefficients $\alpha_i$ and $\beta_i$, for example as relevant to Equations 1 and 2 (Eq. 1 and 2):

$$\sum_{i=1}^{N} \alpha_i C_{1,Z_i} = 1 \quad \text{Eq. 10}$$

$$\sum_{i=1}^{N} \beta_i C_{2,Z_i} = 1 \quad \text{Eq. 11}$$

$$-\sum_{i=1}^{N} \beta_i C_{1,Z_i} = 0 \quad \text{Eq. 12}$$

$$-\sum_{i=1}^{N} \alpha_i C_{2,Z_i} = 0 \quad \text{Eq. 13}$$

Thus, in the encoder 5, applying processing operations as described by Equations 1 to 13 (Eq. 1 to 13), it is feasible to convert input signals corresponding to N channels, namely the input signals for CH1 to CH3 wherein N=3, with two parameters per channel and two down-mix channels to generate signals for the outputs 610, 620 and the third parameter set output 600; the two parameters for the i-th channel are $C_{1,Z_i}$ and $C_{2,Z_i}$. If the down-mix is fixed for every time/frequency tile, the down-mix is known at the decoder 10, so that the relations between the parameters are a priori known. If, on the other hand, it is chosen to vary the down-mix, information regarding the actual down-mix has to be sent to the decoder 10.

In the encoder 5, the input signals CH1 to CH3 are processed in the channel unit 100, 200, 300 to yield a representation of the input signals in time/frequency tiles. Processing operations as depicted by Equations 1 to 13 are repeated for each of these tiles. The signals $L_0[k]$ of all frequency tiles are combined in the encoder 5 and transformed to the time domain to form a signal for the current segment and this signal is at least partially combined with the signal pertaining to at least a preceding segment thereto to generate the encoded output signal 620. The signals $R_o[k]$ are processed in a similar manner to the signals $L_o[k]$ to generate the encoded output signal 610.

In summary, the encoder 5, and similarly the encoder 15 which is a specific example embodiment of the invention, is operable to encode the three input signals CH1 to CH3 as two down-mixed channels 610, 620, namely $l_O[n]$, $r_O[n]$ and 2N−4 parameters for each time/frequency tile applied when processing the input signals CH1 to CH3.

Complementary to the encoder 5 illustrated in FIG. 1, similarly the encoder 15 illustrated in FIG. 3, is a complementary decoder presented schematically in FIG. 2 and indicated therein generally by 10. The decoder 10 includes a processing unit 1000 which is operable to receive the down-mix output signals 610, 620 from the encoder 5 and also the third parameter set output 600 conveying parametric information, for example values for the aforementioned parameters $C_{1,Z_i}$ and $C_{2,Z_i}$. The decoder 10 is operable to process signals from the outputs 600, 610, 620 received thereat to generate decoded output signals 1500, 1510, 1520, which are decoded representations of the input signals CH1, CH2, CH3 respectively.

At the decoder 10, when receiving the outputs 600, 610, 620 from the encoder 5, for example conveyed by way of a communication network such as the Internet and/or a data carrier such as a digital video disk (DVD) or similar data medium, for each time/frequency tile, the following processing functions are performed:

(a) the coefficients $C_{1,Z_i}$ and $C_{2,Z_i}$ are computed for all N channels using the 2N−4 coefficients and the four equations, namely information pertaining to Equations 10 to 13, describing relationships between the coefficients; and then (b) an approximate representation $\hat{Z}_i[k]$ of each input signal $Z_i[k]$ is computed using Equation 14 (Eq. 14):

$$\hat{Z}_i = C_{1,Z_i} L_0[k] + C_{2,Z_i} R_0[k] \qquad \text{Eq. 14}$$

wherein $L_0[k]$ and $R_0[k]$ are the signals representing a time/frequency tile of two down-mix channels received at the decoder 10, namely the outputs 610, 620 respectively.

A specific example embodiment of the decoder 10 illustrated in FIG. 2 in the first context will now be described with reference to FIG. 4 in the second context. In FIG. 4, there is shown a decoder indicated generally by 18. The decoder 18 comprises a segment and transform unit 1600 for transforming the aforementioned down-mix outputs 610, 620 denoted by $r_o$, $l_o$ to generate corresponding transformed signals 1650, 1660 denoted by $R_o$, $L_o$ respectively. Moreover, the decoder 18 also includes a decoding processor 1610 for receiving the signals 600, 1650, 1660 and processing them to generate corresponding processed signals 1700, 1710, 1720 relating to left-channel (L), center channel (C) and right-channel (R) respectively.

The signal 1700 is coupled directly and also via a decorrelator 1750 as shown to an inverse PCA unit 1800 which is operable to generate two intermediate outputs $L_f$, $L_s$ which are coupled to an inverse transform and OLA unit 1900. The inverse transform unit 1900 is operable to process the intermediate outputs $L_f$, $L_s$ to generate decoder outputs 2000, 2010 corresponding to the output 1500 in FIG. 2, namely regenerated versions of the input signals 400, 410.

Similarly, the signal 1710 is coupled directly and also via a decorrelator 1760 as shown to an inverse PCA unit 1810 which is operable to generate two intermediate outputs $C_s$, LFE which are coupled to an inverse transform and OLA unit 1910. The inverse transform unit 1910 is operable to process the intermediate outputs $C_s$, LFE to generate decoder outputs 2020, 2030 corresponding to the output 1510 in FIG. 2, namely regenerated versions of the input signals 420, 430.

Similarly, the signal 1720 is coupled directly and also via a decorrelator 1770 as shown to an inverse PCA unit 1820 which is operable to generate two intermediate outputs $R_f$, $R_s$ which are coupled to an inverse transform and OLA unit 1920. The inverse transform unit 1920 is operable to process the intermediate outputs $R_f$, $R_s$ to generate decoder outputs 2040, 2050 corresponding to the output 1520 in FIG. 2, namely regenerated versions of the input signals 440, 450.

The units 1800, 1810, 1820 require parameter inputs 920, 820, 720 during operation to receive sufficient data for correct operation.

Processing operations executed within the decoding processor 1610, also known as a decoder according to the invention, involve mathematical operations as described in the foregoing with reference to the decoder 10 illustrated in FIG. 2.

It will be appreciated that embodiments of the invention described in the foregoing are susceptible to being modified without departing from the scope of the invention as defined by the accompanying claims.

For example, the encoder 5, similarly the encoder 15, is preferably arranged to function so as to generate a good stereo image in the down-mix outputs by applying Equations 15 and 16 (Eq. 15 and 16) during processing:

$$L_0[k] = L[k] + Cs[k] \qquad \text{Eq. 15}$$

$$R_0[k] = R[k] + Cs[k] \qquad \text{Eq. 16}$$

In such a situation N=3 hence only two parameters per tile, as determined by 2N−4, need to be transmitted from the encoder 5 to the decoder 10. Such an arrangement is of advantage in that the two parameters or coefficients $C_{1,Z_i}$ and $C_{2,Z_i}$ are nominally in a similar numerical range such that similar quantization can be applied to them.

Correspondingly, at the decoder 10, when providing three or more channel playback, there are computed for each tile six parameters, namely $C_{1,L}$, $C_{2,L}$, $C_{1,R}$, $C_{2,R}$, $C_{1,Cs}$ and $C_{2,Cs}$. Such computation is based on two transmitted parameters and information regarding relations between these six parameters.

As an example, the coefficients $C_{1,L}$ and $C_{2,R}$ are transmitted from the encoder 5 to the decoder 10. The decoder 10 is then capable of deriving other coefficients therefrom by way of Equations 17 (Eqs. 17), namely:

$$C_{2,L} = C_{2,R} - 1 \quad C_{1,R} = C_{1,L} - 1$$

$$C_{1,Cs} = 1 - C_{1,L} \quad C_{2,Cs} = 1 - C_{2,R} \qquad \text{Eqs. 17}$$

When these six coefficients have been derived for each tile, representations of output signals within the encoder 5, namely $\hat{L}[k]$, $\hat{R}[k]$ and $\hat{Cs}[k]$, can be regenerated within the decoder 10 by using Equation 18 (Eq. 18) in computations executed within the decoder 10:

$$\begin{bmatrix} \hat{L}[k] \\ \hat{R}[k] \\ \hat{Cs}[k] \end{bmatrix} = \begin{bmatrix} C_{1,L} L_0[k] + C_{2,L} R_0[k] \\ C_{1,R} L_0[k] + C_{2,R} R_0[k] \\ C_{1,C} L_0[k] + C_{2,C} R_0[k] \end{bmatrix} \qquad \text{Eq. 18}$$

These signals $\hat{L}[k]$, $\hat{R}[k]$ and $\hat{Cs}[k]$ are then transformable from the frequency domain to the temporal domain to generate signals 1500 to 1520 for output from the decoder 10 for user appreciation, for example during home movie presentation.

Figure 5:
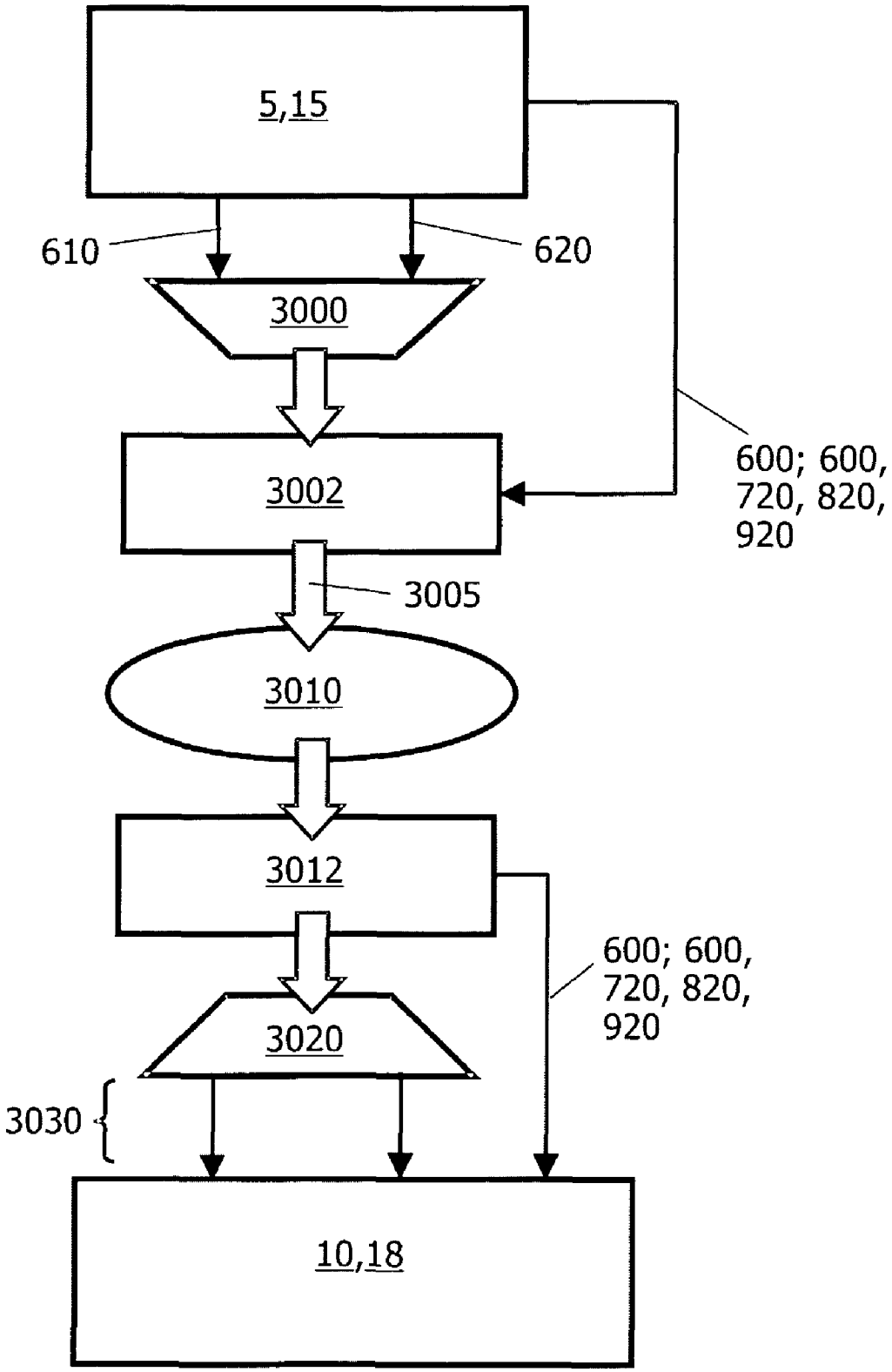
FIG. 5 is a configuration where a multi-channel encoder and a multi-channel decoder according to the invention are mutually configured with a standard stereo encoder and decoder.

In a most straightforward use of the multi-channel encoders 5, 15, a standard stereo coder, namely both encoder and decoder, where M=2 is employed between the multi-channel encoder 5, 15 and the multi-channel decoder 10, 18 described in the foregoing. In other words, referring to FIGS. 3 and 4, the output signals 610, 620 of FIG. 3 are directly fed to a standard stereo encoder 3000 and thereafter via a multiplexer 3002 as depicted in FIG. 5. Outputs 3005 of the multiplexer 3002 which include parameter data (600; 600, 720, 820, 920) are then subsequently conveyed via a data communication route 3010, for example via a data carrier or communication network, to a demultiplexer 3012 and thereafter to a stereo decoder 3020 complementary to the stereo encoder 3000. Decoded output signals 3030 from the decoder 3020 together with the parameter data (600; 600, 720, 820, 920) from the demultiplexer 3012 are fed to the multi-channel decoder 10, 18. The outputs 3030 of the decoder 3020 are regenerated versions of the output signals 610, 620 from the multi-channel encoders 5, 15. A configuration as depicted in FIG. 5 is an example of a manner in which the multi-channel encoders 5, 15 and multi-channels decoders 10, 18 are susceptible to be mutually interconnected.

In the accompanying claims, numerals and other symbols included within brackets are included to assist understanding of the claims and are not intended to limit the scope of the claims in any way.

Expressions such as "comprise", "include", "incorporate", "contain", "is" and "have" are to be construed in a non-exclusive manner when interpreting the description and its associated claims, namely construed to allow for other items or components which are not explicitly defined also to be present. Reference to the singular is also to be construed to be a reference to the plural and vice versa.

The invention claimed is:

1. A multi-channel encoder operable to process input signals conveyed in a plurality of input channels to generate corresponding output data comprising down-mix output signals together with complementary parametric data, the encoder including:

(a) a down-mixer for down-mixing the input signals to generate the corresponding down-mix output signals; and (b) an analyzer for processing the input signals, said analyzer being operable to generate said parametric data complementary to the down-mix output signals, said encoder being operable when generating the down-mix output signals for also generating said parametric data, wherein said parametric data is specifically configured (i) to allow for subsequent decoding of the down-mix output signals (ii) for predicting signals of channels (iii)(1) processed and (iii)(2) then discarded within the encoder, thereby enabling a subsequent decoding via a decoder to substantially regenerate with enhanced accuracy the corresponding channels previously discarded within the encoder by predicting information of the previously discarded channels from the down-mix output signals and the parametric data.

2. The multi-channel encoder according to claim 1, said encoder being operable to process the input signals on the basis of time/frequency tiles.

3. The multi-channel encoder according to claim 2, wherein the tiles are defined either before or in the encoder during processing of the input signals.

4. The multi-channel encoder according to claim 1, wherein the analyzer is operable to generate at least part of the parametric data ($C_{1,i}$;$C_{2,i}$) by applying an optimization of at least one signal derived from a difference between one or more input signals and an estimation of said one or more input signals which can be generated from output data from the multi-channel encoder.

5. The multi-channel encoder according to claim 4, wherein the optimization involves minimizing an Euclidean norm.

6. The multi-channel encoder according to claim 1, wherein there are N input channels which the analyzer is operable to process corresponding original input signals of the N input channels to generate for each time/frequency tile the parametric data, the analyzer being operable to output M(N−M) parameters together with M down-mix output signals for representing the input signals in the output data; M and N being integers and M<N.

7. The multi-channel encoder according to claim 6, wherein the integer M is equal to two such that the output signals are susceptible to being replayed in a two-channel stereophonic apparatus and being coded by a standard stereo coder.

8. A signal processor for inclusion in a multi-channel encoder according to claim 1, the processor being operable to process data in the multi-channel encoder for generating its down-mix output signals and parametric data.

9. A multi-channel decoder for decoding output data generated by an multi-channel encoder according to claim 1, the decoder comprising:

(a) processing means for receiving down-mix output signals together with parametric data from the encoder, the processing means being operable to process the parametric data to determine one or more coefficients or parameters; and (b) computing means for calculating an approximate representation of each input signal encoded into the output data using the parameter data and also the one or more coefficients determined in step (a) for further processing to substantially regenerate representations of input signals giving rise to the output data generated by the encoder.

10. A signal processor for use in a multi-channel decoder according to claim 9, said signal processor being operable to assist in processing data in association with regenerating representations of input signals.

11. A method of decoding encoded data in a multi-channel decoder, said data being of a form as generated by a multi-channel encoder according to claim 1, the method including steps of:

(a) processing down-mix output signals together with parametric data present in the encoded data, said processing utilizing the parametric data to predict one or more coefficients or parameters; and (b) calculating an approximate representation of each input signal encoded into the encoded data using the parameter data and also the one or more coefficients determined in step (a) for further processing to substantially regenerate representations of input signals giving rise to the encoded data generated by the encoder.

12. A method of encoding input signals in a multi-channel encoder to generate corresponding output data comprising down-mix output signals together with complementary parametric data, the method including steps of:

(a) providing the input signals to the encoder via a plurality of (N) input channels;

(b) down-mixing the input signals to generate the corresponding (M) down-mix output signals; and (c) processing the input signals to generate said parametric data complementary to the down-mix output signals, wherein processing of the input signals in the multi-channel encoder involves determining the parameter data for enabling representations of the input signals to be subsequently regenerated, said down-mix output signals and parametric data (i) allowing for decoding of the down-mix output signals (ii) for predicting content of signals of channels (iii)(1) processed in the encoder and (iii)(2) then discarded within the encoder, thereby enabling a subsequent decoding via a decoder to substantially regenerate with enhanced accuracy the corresponding channels previously discarded within the encoder by predicting information of the previously discarded channels from the down-mix output signals and the parametric data.

13. Encoded output data generated according to the method of claim 12, said output data stored on a data carrier.

* * * * *